United States Patent [19]

Bains

[11] Patent Number: 5,038,150

[45] Date of Patent: Aug. 6, 1991

[54] FEED NETWORK FOR A DUAL CIRCULAR AND DUAL LINEAR POLARIZATION ANTENNA

[75] Inventor: Paramjit S. Bains, Los Angeles, Calif.

[73] Assignee: Hughes Aircraft Company, Los Angeles, Calif.

[21] Appl. No.: 522,752

[22] Filed: May 14, 1990

[51] Int. Cl.[5] ..... H01Q 19/00

[52] U.S. Cl. ..... 342/373; 342/188

[58] Field of Search ..... 342/188, 361, 365, 366, 342/368, 373; 343/756, 776, 786

[56] References Cited

U.S. PATENT DOCUMENTS 4,907,004 3/1990 Zacharatos et al. ..... 342/313

4,972,199 11/1990 Raghavan et al. ..... 343/756

*Primary Examiner*—Mark Hellner

*Attorney, Agent, or Firm*—Robert A. Westerlund; Steven M. Mitchell; Wanda K. Denson-Low

[57] ABSTRACT

A feed network for an antenna system, e.g., a phased array antenna system, which is operatively associated with a signal source, e.g., satellite-based transponders, which generates first and second R.F. signals of circular polarization, and third and fourth R.F. signals of orthogonal linear polarizations. The feed network includes a 3dB hybrid coupler or the like for splitting each of the first and second R.F. signals into first and second signal components disposed in phase quadrature with each other. Facilities are provided for applying the first signal components of the first and second R.F. signals, and the third R.F. signal, to a first beam forming network (BFN); and, for separately applying the second signal components of the first and second R.F. signals, and the fourth R.F. signal, to a second BFN. Subsequent to their emergence from the BFN's, the first and second signal components of each of the first and second R.F. signals are applied to respective through and side ports of ortho-mode-tees (OMT's) which Function to re-combine the first and second signal components, in phase quadrature, in order to thereby produce output first and second R.F. signals of opposite-sense (i.e., dual) circular polarizations. The third and fourth R.F. signals pass unaffected through the OMT's as output third and fourth R.F. signals of orthogonal (i.e., dual) linear polarizations. The first, second, third, and fourth output R.F. signals are then fed through common transmission lines to excite the individual antenna elements of the antenna system.

25 Claims, 2 Drawing Sheets

FEED NETWORK FOR A DUAL CIRCULAR AND DUAL LINEAR POLARIZATION ANTENNA

FIELD OF THE INVENTION

The present invention relates generally to feed networks for antenna systems, e.g., for phased array antenna systems utilized in satellite communications systems, and more particularly, to a feed network having a unique architecture which renders the feed network capable of simultaneously feeding R.F. signals of orthogonal linear polarizations and R.F. signals of opposite-sense circular polarizations to the antenna element(s) of a single antenna system.

BACKGROUND OF THE INVENTION

In various types of communications systems, it is desirable to increase the available bandwidth by means of isolating the R.F. beams received/transmitted by the receiving/transmitting antenna system. Two prominent techniques which are currently used to achieve this desired beam isolation in these antenna systems are, spatial and polarization isolation of the beams. The need for high antenna gain and high system bandwidth is particularly acute in communications systems which provide thousands of independent communications channels with high efficiency and minimum intermodulation distortion and channel cross-talk.

Furthermore, there are other antenna systems which are configured to serve multiple functions which require signals of different polarizations, e.g., antenna systems employed in spaceborne satellites designed to simultaneously perform surveillance and meteorological and/or astronomical observation functions.

Accordingly, it can be appreciated that, in certain instances, it is desirable to have an antenna system which is capable of simultaneously transmitting and/or receiving separate R.F. beams of linear and circular polarizations. In this connection, presently available antenna systems require the utilization of separate antenna feed networks and separate antennas in order to be rendered capable of simultaneously transmitting and/or receiving separate R.F. signals of linear and circular polarizations. In some instances, it is even more desireable to have an antenna system which is capable of simultaneously transmitting and/or receiving separate R.F. signals of orthogonal linear polarizations, and separate R.F. signals of opposite-sense circular polarizations. In this connection, although it is within the state-of-the-art to feed either separate orthogonally linear polarized R.F. signals or separate opposite-sense circularly polarized R.F. signals through a common antenna feed network, it is not within the present state-of-the-art to feed both separate orthogonally linear polarized R.F. signals and separate opposite-sense circularly polarized R.F. signals through a common antenna feed network. Rather, in these current state-of-the-art antenna systems, it is necessary to utilize separate antennas and separate antenna feed networks for each of the above-identified R.F. signal pairs. Of course, for reasons of cost and weight economy, it would be highly advantageous to have available an antenna system which requires only a single antenna and a single antenna feed network for both of the above-identified R.F. signal pairs.

The present invention is directed to providing such a highly advantageous antenna system.

SUMMARY OF THE INVENTION

The present invention encompasses a feed network for an antenna system which is operatively associated with a signal source which generates at least one linearly polarized R.F. signal and at least one circularly polarized signal, with the feed network being common to all of these R.F. signals and functioning to feed all of these R.F. signals to the N individual antenna elements, e.g., feed horns, of the antenna system, e.g., a phased array antenna system of the direct radiating or reflector type, such as are employed in satellite communications systems.

In a preferred embodiment of the present invention, the feed network includes a 3 dB hydrid coupler for splitting each of first and second circularly polarized R.F. signals into first and second signal components disposed in phase quadrature with each other. The feed network also includes first and second signal transmission lines for separately feeding the first and second signal components of the first and second R.F. signals to respective first and second beam forming networks (BFN's). The first signal transmission line is preferably operatively associated with a first multiplexer for facilitating common transmission of the first signal components of the first and second R.F. signals, and a third R.F. signal having a prescribed linear polarization (e.g., horizontal), to the first beam forming network. The second signal transmission line is preferably operatively associated with a second multiplexer for facilitating common transmission of the second signal components of the first and second R.F. signals, and a fourth R.F. signal having a prescribed linear polarization (e.g., vertical) orthogonal to that of the third R.F. signal. The first and second BFN's distribute each of the signals applied thereto into N component signals.

The feed network further includes N ortho-mode-tees (OMT's) each of which has a through port and a side port. The N component signals of the first signal components of the first and second R.F. signals, and the N signal components of the third R.F. signal, are applied to the through port of respective ones of the OMT's. The N component signals of the second signal components of the first and second R.F. signals, and the N signal components of the fourth R.F. signal, are applied to the side port of respective ones of the OMT's. The N signal components of the first and second signal components of each of the first and second R.F. signals are re-combined at the OMT's, in phase quadrature, to thereby produce N output first and second R.F. signals having opposite senses of circular polarization (i.e., RHCP and LHCP). The N component signals of the third and fourth R.F. signals remain intact when passing through the OMT's, and exit therefrom as N orthogonal linearly polarized output third and fourth R.F. signals. Thereafter, the N component signals of all the output R.F. signals are applied through common transmission lines to the N antenna elements.

In an alternative embodiment, the feed network of the present invention has an architecture which is virtually identical to that of the above-described preferred embodiment, except that N pin polarizers are provided between the OMT's and the antenna elements. However, in the alternative embodiment, the first and second R.F. signals are of orthogonal linear polarizations, whereby the first and second signal components recombine at the OMT's to produce output first and second R.F. signals of opposite-sense circular polarizations. The pin polarizes function to convert the opposite-sense circularly polarized third and fourth R.F. signals to orthogonal linear polarized output third and fourth R.F. signals.

The first and second R.F. signals preferably occupy different frequency bands as compared to the third and fourth R.F. signals.

Other objects, features, aspects, and advantages of the present invention will become apparent from the following detailed description of the invention taken in conjunction with the accompanying drawings, in which:

DETAILED DESCRIPTION OF THE INVENTION

Figure 1:
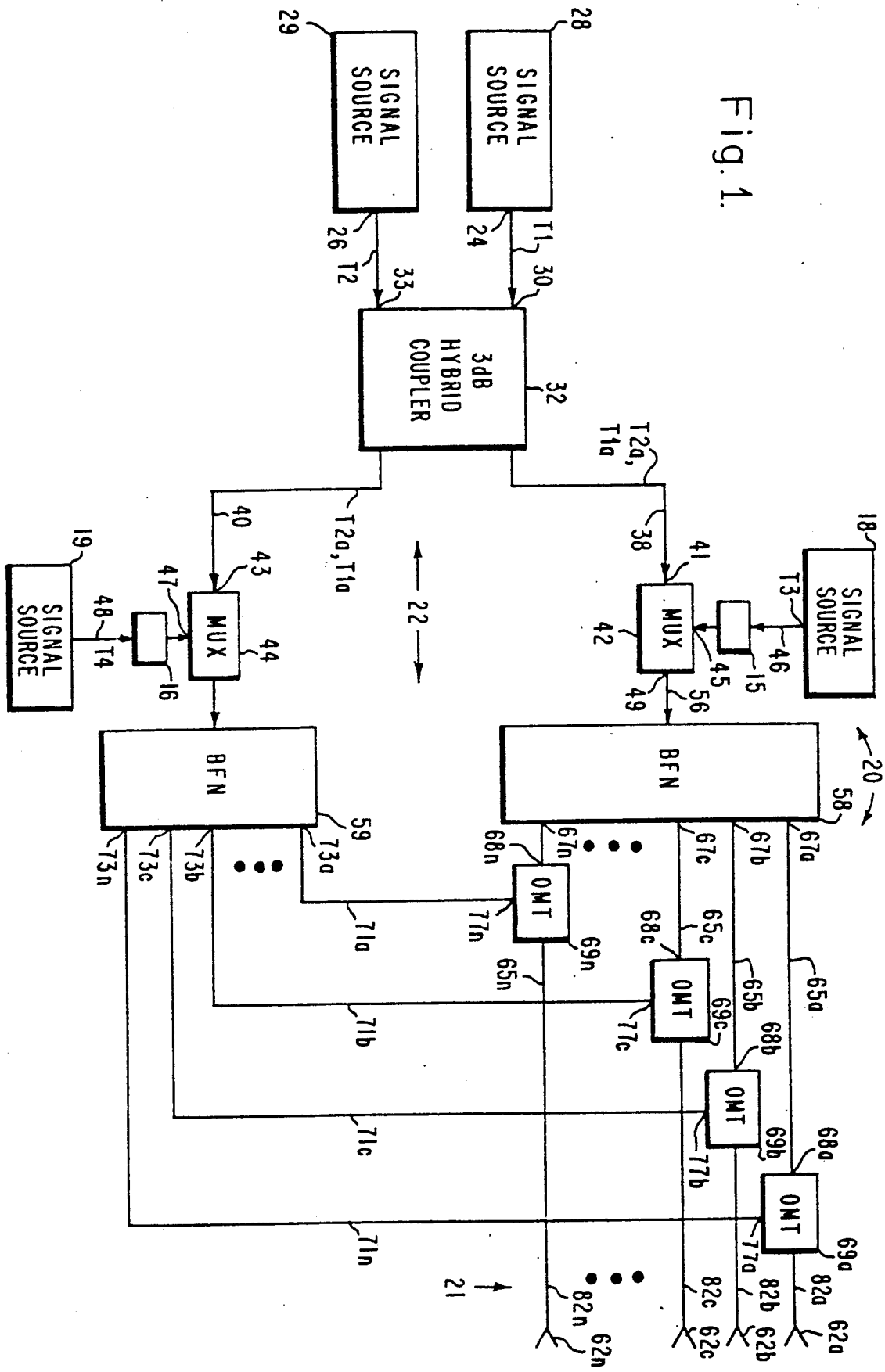
FIG. 1 is a functional block diagram of an antenna system which incorporates a feed network constituting a preferred embodiment of the present invention.
Figure 2:
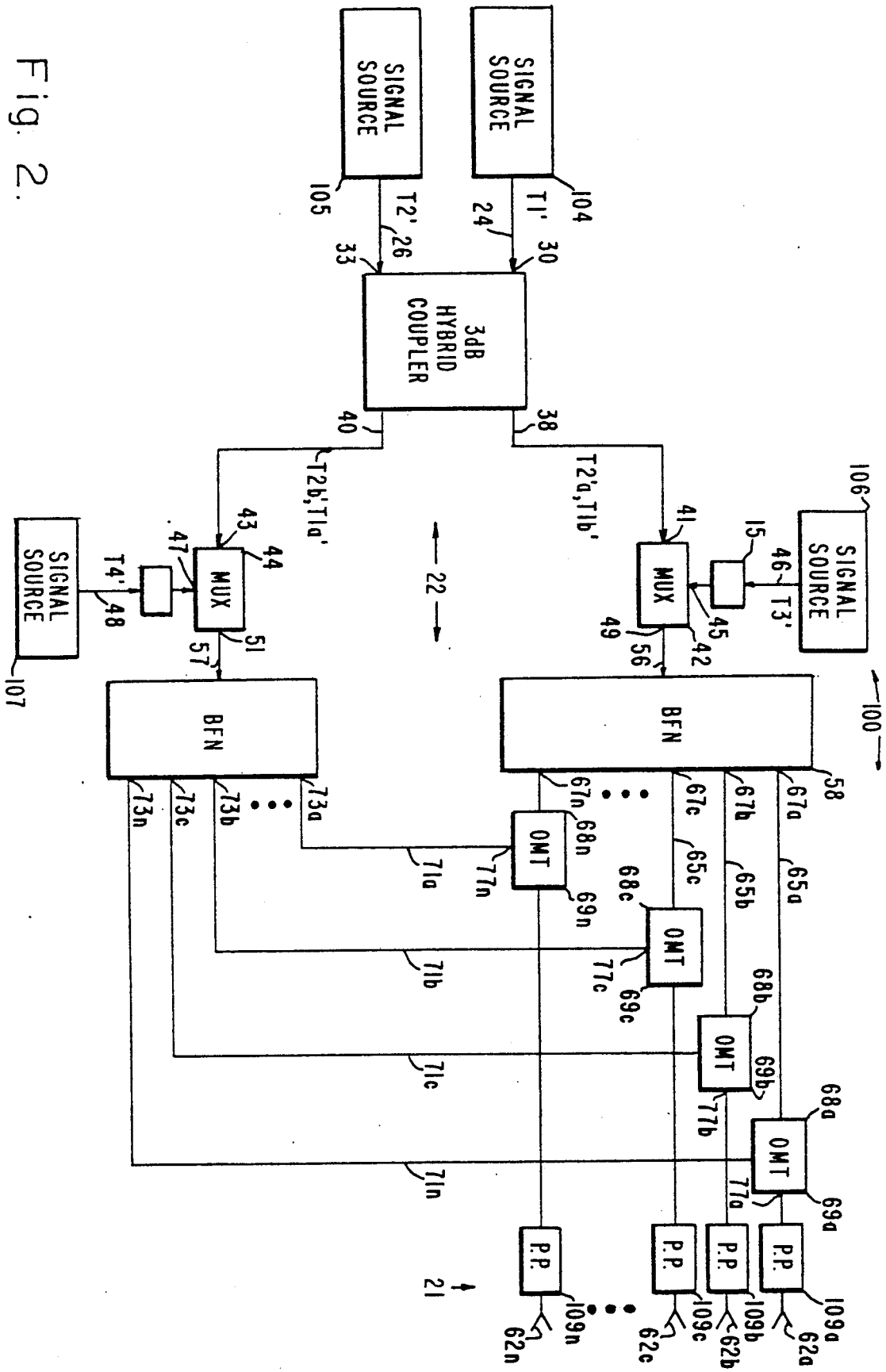
FIG. 2 is a functional block diagram of an antenna system which incorporates a feed network constituting an alternative embodiment of the present invention.

Referring now to FIGS. 1 and 2, the present invention encompasses a single feed network for feeding one or more antenna elements of a singular antenna system with four separate transmit signals T1–T4, wherein the signals T1 and T2 are of opposite-sense circular polarizations (i.e., right-hand and left-hand circularly polarized signals, respectively), and the signals T3 and T4 are of orthogonal linear polarizations (i.e., vertical and horizontal linear circularly polarized signals, respectively). Typically, although not limiting to the present invention, the antenna system is employed in a communications satellite (not shown) which is placed in geosynchronous orbit around the earth (not shown). Alternatively, of course, the antenna system may be employed in radar, meteorological, astronomical, scientific, surveillance, or other types of observation satellites (not shown), or any other convenient type of satellite. Further, it should be appreciated that the particular type of antenna system employed in conjunction with the feed network of the present invention is not critical or limiting to practice of the present invention. For example, the antenna system may conveniently be of the reflector or direct radiating type, and may suitably be comprised of a multiplicity of individual antenna or radiating elements arranged in any suitable geometrical configuration, in accordance with the desired coverage and beam characteristics of the particular antenna system under consideration. Illustratively, the antenna elements may be arranged in a one-dimensional linear array, a two-dimensional planar array, or a three-dimensional spherical array. Generally, the array of individual elements are fed with R.F. power (e.g., in the microwave domain) at controlled relative phases and amplitudes, whereby the elements cooperate in a well-known manner, e.g., in a transmit mode of operation, to produce one or more focussed beams of electromagnetic radiation (e.g., a microwave R.F.-signal) having a desired far field pattern pointed in a desired direction to thereby provide a desired beam coverage area. The required phase and amplitude distributions are generally implemented in any convenient manner by beam forming networks consisting of various forms and combinations of power dividers, couplers, phase shifters (fixed and/or variable), and switching matrices, as are well-known in the art of antenna systems. Further, the resultant beam or beams produced by this excitation of the array of antenna elements may also be electronically steered or scanned by these beam forming networks to any desired beam scan angle within a 360° azimuth coverage area. Illustrative of the beam forming (and steering) networks presently available are the ones disclosed in U.S. Pat. Nos. 4,257,050, issued to Ploussious; 4,639,732, issued to Acaraci et al.; 4,532,519, issued to Rudish et al.; and, 4,825,172 issued to Thompson, all of whose teachings are herein incorporated by reference.

In light of the above and foregoing, it will be appreciated that the particular type or construction of the various components constituting the antenna system are not critical or limiting to either the scope or practice of the present invention. As such, since the hardware implementation of these various components of the present invention will be easily and readily accessible to those skilled in the art of antenna systems, these various components will only be referred to generically in the following description of the present invention. In this regard, it will become apparent that the novelty of the present invention resides primarily in a unique combination and architectural configuration of these various components in order to facilitate simultaneous feeding of separate signals of orthogonal linear polarizations and separate signals of opposite-sense circular polarizations, through a single feed network and utilizing a single antenna system, rather than through two separate feed networks utilizing two separate antenna systems, as was necessary heretofore. In any event, a thorough explanation of the principles of operation and details of construction of antenna systems, e.g., phased array antenna systems, and feed networks therefor can be found in the publication entitled "Phased Array Antennas," by Oliver and Knittel (Proceeding of the 1970 Phased Array Antenna Symposium), published by Artech House, Inc. of Dedham, Mass. (Library of Congress Catalog Card No. 73-189392), and the text, "Radar Handbook," by Merrill I. Skolnik (McGraw Hill, 1970). The discussion will now proceed to a description of a preferred embodiment of the present invention.

More particularly, with specific reference now to FIG. 1, there can be seen an antenna system 20 incorporating a feed network 22 constituting a preferred embodiment of the present invention. The feed network 22 includes transmission lines 24, 26 which receive R.F. signals T1 and T2, respectively, from any suitable signal sources 28, 29, respectively, e.g., from transponders of a spaceborne communications satellite (not shown). The term "transmission line" as used hereinthroughout is intended to encompass any convenient type of electromagnetic signal-carrying device, including, but not limited to, conductors, waveguides, travelling wave tubes, microwave transmission strip lines, coaxial lines, microstrip lines, or the like. The R.F. signals T1 and T2 are of frequencies, $f_1$ and $f_2$, and are circularly polarized. For example, in one presently contemplated application of the instant invention, the T1 and T2 signals are Direct Broadcast Service (DBS) microwave-R.F. signals which occupy adjacent microwave frequency bands within the overall DBS band of 12.25–12.75 GHz. The transmission line 24 is coupled at its output to a first input port 30 of a 3 dB directional coupler 32, which is sometimes referred to as a quadrature hybrid junction or coupler because it divides the power inserted in each input port thereof equally between its two output ports, with phase quadrature between the output signals, i.e., the half-power signal component output through one output port is phase shifted by ±90 relative to the half-power signal component output through the other output port. Specifically, the T1 signal conveyed by the transmission line 24 is inserted in the first input port 30 of the hybrid coupler 32. The hybrid coupler 32 divides the T1 signal into two equal power signal components $T1_a$ and $T1_b$ which are output through the output ports 34, 36, into transmission lines 38, 40 coupled thereto, respectively. The signal component $T1_b$ is phase-delayed by 90° relative to the signal component $T1_a$, by the action of the hybrid coupler 32. Similarly, the transmission line 26 is coupled at its output to a second input port 31 of the hybrid coupler 32, whereby the T2 signal is inserted in the second input port 33. The hybrid coupler 32 divides the T2 signal into two equal power signal components $T2_a$ and $T2_b$ which are output through the output ports 34, 36 and into the transmission lines 38, 40 respectively. The signal component $T2_a$ is phase-delayed by 90° relative to the signal component $T2_b$, by the action of the hybrid coupler 32.

The transmission line 38 is coupled at its output to a first input port 41 of a first multiplexer 42. The transmission line 40 is coupled at its output to a first input port 43 of a second multiplexer 44. The feed network 22 also includes transmission lines 46, 48 which receive R.F. signals T3 and T4, respectively, from any suitable signal sources 18, 19, respectively, e.g., from transponders of a satellite. The R.F. signals T1 and T3 are preferably (and generally) of different frequencies, $f_1$ and $f_3$, and the R.F. signals T2 and T4 are preferably of different frequencies $f_2$ and $f_4$. The frequencies $f_1$ and $f_2$ may overlap or not overlap, and likewise, the frequencies $f_3$ and $f_4$ may overlap or not overlap. For example, in one presently contemplated application of the instant invention, the T3 and T4 signals are Fixed Satellite Service (FSS) microwave-R.F. signals which occupy adjacent microwave frequency bands within the overall FSS band of 11.75–12.25 GHz. Further, the T3 and T4 signals are preferably of orthogonal linear polarizations, e.g., the T3 signal is horizontally polarized and the T4 signal is vertically polarized. The transmission line 46 is coupled at its output to a directional coupler 15 whose output is coupled to a second input port 45 of the first multiplexer 42. The transmission line 48 is coupled at its output to a second directional coupler 16 whose output is coupled to a second input port 47 of the second multiplexer 44. The first multiplexer 42 has a single output port 49 which is coupled to the input end of a transmission line 56 which is coupled at its output end to a first beam forming network 58. The second multiplexer 44 has a single output port 51 which is coupled to the input end of a transmission line 57 which is coupled at its output end to a second beam forming network 59. Thus, the signals $T1_a$, $T2_a$, and T3 are applied simultaneously via the transmission line 56 to the first beam forming network (BFN) 58; and, the signals $T1_b$, $T2_b$, and T4 are applied simultaneously via the transmission line 57 to the second beam forming network (BFN) 59. The BFN's 58, 59 function in a well-known manner to distribute the respective signals applied thereto into a number N of component signals, corresponding to the number N of antenna elements 62 incorporated within the antenna system 20. Of course, the BFN's 58, 59 also normally function to impart the required phase and amplitude distributions to the respective signals applied thereto. As previously mentioned, the particular type of beam forming networks employed is not limiting to the present invention.

With continuing reference to FIG. 1, it can be seen that the feed network 22 further includes a plurality N of transmission lines 65 (A-N) coupled at their input ends to output ports 67 (A-N) of the first BFN 58, and at their output ends to through ports 68 (A-N) of respective ortho-mode-tees (OMT's) 69 (A-N). Similarly, a plurality N of transmission lines 71 (A-N) are connected between output ports 73 (A-N) of the second BFN 59 and side ports 77 (A-N) of the OMT's 69 (A-N).

The T1 signal components $T1_a$ and $T1_b$ are re-combined at the OMT's 69 (A-N), and the T2 signal components $T2_a$ and $T2_b$ are also re-combined at the OMT's 69 (A-N). It is important that the physical construction of the feed network 22 be such as to ensure that the T1 signal components $T1_a$ and $T1_b$ maintain their phase quadrature and relative amplitude relationship throughout their propagation through the various components of the feed network 22, so that they re-combine at the OMT'S 69 (A-N) to produce right-hand circularly polarized (RHCP) output T1 signals. Similarly, it is equally important that the physical construction of the feed network 22 be such as to ensure that the T2 signal components $T2_a$ and $T2_b$ maintain their phase quadrature and relative amplitude relationship throughout their propagation through the various components of the feed network 22, so that they re-combine at the OMT's 69 (A-N) to produce left-hand circularly polarized (LHCP) output T2 signals.

The polarization of the in-phase, orthogonally linearly polarized signals T3 and T4 is not affected by the OMT's 69 (A-N). Therefore, it can be readily appreciated that the OMT's 69 (A-N) output the signals T1, T2, T3, and T4 over output transmission lines 82 (A-N), for simultaneous excitation of the array 21 of antenna elements 62 (A-N). Thus, the feed network 22 of the present invention facilitates simultaneous transmission of dual circular and dual linear polarization beams via the single antenna system 20.

Referring now to FIG. 2, there can be seen an alternative embodiment of the present invention. More particularly, there can be seen an antenna system 100 incorporating a feed network 102 constituting an alternative embodiment of the present invention. For the sake of simplicity and in order to facilitate greater ease of description of this alternative embodiment, like reference numerals are used in FIGS. 1 and 2 to designate like components. In this vein, the alternative embodiment depicted in FIG. 2 will be described only in terms of the differences between this embodiment and the embodiment depicted in FIG. 1.

Generally speaking, the principal difference between the feed network 22 constituting the preferred embodiment of the present invention, and the feed network 102 constituting an alternative embodiment of the present invention, resides in the nature of the signals processed thereby. More particularly, the transmission lines 24, 26 receive R.F. signals T1' and T2', respectively, from any suitable signal sources 104, 105, e.g., transponders, the signals T1' and T2' being of orthogonal linear polarizations, e.g., the signal T1' is horizontally polarized, and the signal T2' is vertically polarized. By way of example, the T1' and T2' signals may be FSS signals which occupy adjacent microwave frequency bands within the overall FSS band. The hybrid coupler 32 divides the T1' signal into two equal power components $T1'_a$ and $T1'_b$, with the signal component $T1'_b$ being phase-delayed by 90° relative to the signal component $T1'_a$. Further, the hybrid coupler 32 divides the T2' signal into two equal power signal components $T2'_a$ and $T2'_b$, with the signal component $T2'_a$ being phase-delayed by 90° relative to the signal component $T2'_b$. Additionally, the transmission lines 46, 48 receive R.F. signals T3' and T4' respectively, from signal sources 106, 107, respectively, e.g., transponders, the signals T3' and T4' being of opposite-sense circular polarizations, e.g., the T3' signal is right-hand circularly polarized, and the T4' signal is left-hand circularly polarized. By way of example, the T3' and T4' signals may be DBS signals which occupy adjacent microwave frequency bands within the overall DBS band. As with the preferred embodiment, the signals T1' and T3' are preferably (and generally) of different frequencies, $f_1'$ and $f_3'$, and the signals T2' and T4' are preferably of different frequencies, $f_2'$ and $f_4'$. The frequencies $f_1'$ and $f_2'$ may overlap or not overlap, and likewise, the frequencies $f_3'$ and $f_4'$ may overlap or not overlap.

After passage through the BFN's 58, 59, the signal components $T1'_a$ and $T1'_b$ are re-combined at the OMT's 69 (A-N), and the signal components $T2'_a$ and $T2'_b$ are also re-combined at the OMT's 69 (A-N). It is important that the physical construction of the feed network 102 be such as to ensure that the T1' signal components $T1'_a$ and $T1'_b$ maintain their phase quadrature and relative amplitude relationships throughout their propagation through the various components of the feed network 102, so that they are re-combined at the OMT's 69 (A-N) to produce circularly polarized intermediate T1' signals. Similarly, it is equally important that the physical construction of the feed network 102 be such as to ensure that the T2' signal components $T2'_a$ and $T2'_b$ maintain their phase quadrature and relative amplitude relationship throughout their propagation through the various components of the feed network 102, so that they are re-combined at the OMT's 69 (A-N) to produce circularly polarized intermediate T2' signals.

The polarization of the in-phase, opposite-sense, circularly polarized signals T3' and T4' (A-N) is not affected by the OMT's 69 (A-N). However, the feed network 102 also includes pin or screw polarizers 109 (A-N), sometimes referred to as iris polarizers, connected between the output transmission lines 82 (A-N) and the antenna elements 62 (A-N). The pin polarizers 109 (A-N) function in a well-known manner to transform the circularly polarized intermediate T1' signals into horizontally polarized T1' output signals, and, to transform the circularly polarized intermediate T2' signals into vertically polarized T2' output signals, or vice versa. Thus, it can be readily appreciated that the antenna elements 62 (A-N) are simultaneously excited by the opposite-sense circularly polarized T1' and T2' output signals, and the orthogonal linear polarized T3' and T4' output signals. Therefore, the feed network 102 of the present invention facilitates simultaneous transmission of dual circular and dual linear polarization beams via the single antenna system 100.

Although a preferred and an alternative embodiment of the present invention have been described in detail, it should be clearly understood that many variations and/or modifications of the basic inventive concepts herein taught which may appear to those skilled in the pertinent art will still fall within the spirit and scope of the present invention, which should be interpreted on the basis of the claims appended hereto. For example, although each "pair" of the simultaneously fed signals have been illustratively described as occupying adjacent frequency bands, it should be recognized that the only limitation on the frequency bands of these signals is that they fall within the bandwidth capability of the transmission lines, which are normally intrinsically bandwidth-limited (e.g., 20%–40% BW). Further, in many applications, it is desirable to provide a multiplicity of signals from each signal source (e.g., from a multiplicity of transponders), with the signals of each polarization covering the full frequency spectrum of a prescribed transmission frequency band or band portion (e.g., the lower half of the DBS band). Yet further, for example, the transmission frequency band covered by the signals of each polarization could be divided into a plurality of channels, each of which could be divided into a plurality of subchannels. In such a case, the multiplicity of signals from each signal source would each cover a discrete frequency sub-band corresponding to the assigned frequencies for the channels and subchannels. Therefore, the multiplicity of signals from each signal source would be multiplexed prior to being fed to the hybrid coupler or multiplexer of the feed network of the present invention, in a manner readily apparent to those skilled in the art of antenna systems. In this connection, reference may be made to U.S. Pat. Nos. 4,879,711 issued to Rosen, and 4,825,172, issued to Thompson, both of whose teachings are herein incorporated by reference. Additionally, it should be recognized that an array of diplexers may be provided to render the described antenna systems reciprocal, i.e., capable of operating in both transmit and receive modes. Also, it should be recognized that less than or more than four different polarizations may be accommodated by the feed network of the present invention, e.g., a first transmit signal T1 of one sense of circular polarization, and a second transmit signal T2 of one plane of linear polarization. Yet further, it should be appreciated that the output signals fed to the antenna elements by the feed network of the present invention are normally amplified by an antenna driver system, e.g., an amplifier array or system comprised of low-noise amplifiers (LNA's) and/or solid-state power amplifiers (SSPA's). Finally, it should also be recognized that the antenna system utilizing the feed network of the present invention will normally also be provided with upconverters and/or downconverters, for facilitating uplink and/or downlink transmissions, as is also well-known in the art of antenna systems.

What is claimed is:

1. In an antenna system including N individual antenna elements, a single feed network for feeding at least a first R.F. signal, having a circular polarization, and a second R.F. signal, having a linear polarization, provided by a signal source, to the N antenna elements, the feed network comprising:

means for splitting said first R.F. signal into first and second signal components disposed in phase quadrature relationship with each other;

beam forming network means;

first means for applying said first and second signal components of said first R.F. signal, and said second R.F. signal, to said beam forming network means;

wherein said beam forming network means is adapted to divide each signal applied thereto into N component signals;

N ortho-mode-tees, each of said ortho-mode-tees having a through port and a side port;

second means for applying said N component signals of said first signal component, and said N component signals of said second R.F. signal to said through port of respective ones of said N ortho-mode-tees;

third means for applying said N component signals of said second R.F. signal to said side port of respective ones of said N ortho-mode-tees;

wherein said N component signals of said first and second signal components of said first R.F. signal are re-combined at said respective ones of said N ortho-mode-tees, in phase quadrature, to thereby produce N output first R.F. signals having a prescribed sense of circular polarization;

wherein said N component signals of said second R.F. signal are passed through said respective ones of said ortho-mode-tees, with their polarization intact, as N output second R.F. signals having a linear polarization; and, fourth means for applying said N output first R.F. signals and said N output second R.F. signals to respective ones of said N antenna elements.

2. The feed network as set forth in claim 1, wherein said splitting means comprises a hybrid coupler.

3. The feed network as set forth in claim 1, wherein N is greater than one.

4. The feed network as set forth in claim 1, wherein said first applying means comprises:

first signal transmission means common to both said first signal component of said first R.F. signal, and said second R.F. signal; and, second signal transmission means for propagating said second signal component of said first R.F. signal.

5. The feed network as set forth in claim 4, wherein said second applying means comprises third signal transmission means common to both said N component signals of said first signal component of said first R.F. signal, and said N component signals of said second R.F. signal.

6. The feed network as set forth in claim 5, wherein said fourth applying means comprises fourth signal transmission means common to said N output first R.F. signals and said N output second R.F. signals.

7. The feed network as set forth in claim 6, wherein the antenna system is a phased array antenna system.

8. The feed network as set forth in claim 6, wherein said beam forming network means comprises:

a first beam forming network for receiving signals only from said first signal transmission means; and, a second beam forming network for receiving signals only from said second signal transmission means.

9. The feed network as set forth in claim 6, wherein the signal source further provides a third R.F. signal, having a circular polarization, and wherein further:

said splitting means further operates to split said third R.F. signal into first and second signal components disposed in phase quadrature relationship with each other;

said first applying means further operates to apply said first and second signal components of said third R.F. signal to said beam forming network means;

said second applying means further operates to apply said N component signals of said first signal component of said third R.F. signal to said through port of respective ones of said N ortho-mode-tees;

said third applying means further operates to apply said N component signals of said second signal component of said third R.F. signal to said side port of respective ones of said N ortho-mode-tees; and, said N component signals of said first and second signal components of said third R.F. signal are re-combined at said respective ones of said N ortho-mode-tees, in phase quadrature, to thereby produce N output third R.F. signals having a prescribed sense of circular polarization.

10. The feed network as set forth in claim 9, wherein said prescribed sense of circular polarization of said N output third R.F. signals is opposite to said prescribed sense of circular polarization of said N output first R.F. signals.

11. The feed network as set forth in claim 10, wherein:

said first signal component of said first R.F. signal is phase-delayed by 90° relative to said second signal component of said first R.F. signal; and, said second signal component of said third R.F. signal is phase-delayed by 90° relative to said first signal component of said third R.F. signal.

12. The feed network as set forth in claim 10, wherein said first signal transmission means is also common to said first signal component of said third R.F. signal, and said second signal transmission means is also common to said second signal component of said third R.F. signal.

13. The feed network as set forth in claim 9, wherein the signal source further provides a fourth R.F. signal, having a linear polarization, and wherein further:

said first applying means further operates to apply said fourth R.F. signal to said beam forming network means;

said third applying means further operates to apply said N component signals of said fourth R.F. signal to said side port of respective ones of said N ortho-mode-tees;

wherein said N component signals of said fourth R.F. signals are passed through said respective ones of said N ortho-mode-tees with their polarization intact as N output fourth R.F. signals; and, wherein said linear polarizations of said N output third and fourth R.F. signals are orthogonal.

14. The feed network as set forth in claim 13, wherein said fourth applying means is also in common with said N output third and fourth R.F. signals, said fourth applying means further operating to apply said N output third and fourth R.F. signals to said N antenna elements.

15. The feed network as set forth in claim 14, wherein said first and third R.F. signals occupy different first and second frequency bands, respectively.

16. The feed network as set forth in claim 15, wherein said second and fourth R.F. signals occupy different third and fourth frequency bands, respectively.

17. In an antenna system including N individual antenna elements, a single feed network for feeding at least first and second R.F. signals having orthogonal linear polarizations, and a third R.F. signal having a circular polarization, provided by a signal source, to the N antenna elements, the feed network comprising:

means for splitting each of said first and second R.F. signals into first and second signal components thereof, with said first and second signal components of each of said first and second R.F. signals being disposed in phase quadrature with each other;

beam forming network means;

first means for applying said first and second signal components of said first and second R.F. signals, and said third R.F. signal, to said beam forming network means;

wherein said beam forming network means functions to distribute each signal applied thereto into N component signals;

N ortho-mode-tees, each of said ortho-mode-tees having a through port and a side port;

second means for applying said N component signals of said first signal components of said first and second R.F. signals, and said N component signals of said third R.F. signal, to said through port of respective ones of said N ortho-mode-tees;

third means for applying said N component signals of said second signal components of said first and second R.F. signals to said side port of respective ones of said N ortho-mode-tees;

wherein said N component signals of said first and second signal components of said first R.F. signal are re-combined at said respective ones of said N ortho-mode-tees, in phase quadrature, to thereby produce N intermediate first R.F. signals having a first prescribed sense of circular polarization;

wherein said N component signals of said first and second signal components of said second R.F. signal are re-combined at said respective ones of said N ortho-mode-tees, in phase quadrature, to thereby produce N intermediate second R.F. signals having a second prescribed sense of circular polarization, opposite to said first prescribed sense of circular polarization;

wherein said N component signals of said third R.F. signal are passed through said respective ones of said N ortho-mode-tees with their circular polarization intact, as N output third R.F. signals;

means for transforming said N intermediate first and second R.F. signals into N output first and second R.F. signals having orthogonal linear polarizations;

fourth means for applying said N output first, second, and third R.F. signals to respective ones of said N antenna elements.

18. The feed network as set forth in claim 17, wherein the signal source further provides a fourth R.F. signal, having a prescribed sense of circular polarization opposite to that of said circular polarization of said third R.F. signal, and wherein further:

said first applying means further functions to apply said fourth R.F. signal to said beam forming network means;

said third applying means further functions to apply said N component signals of said fourth R.F. signal to said side port of respective ones of said N ortho-mode-tees, wherein said N component signals of said fourth R.F. signal are passed through said respective ones of said N ortho-mode-tees with their prescribed sense of circular polarization intact, as N output fourth R.F. signals; and, said fourth applying means further functions to apply said N output fourth R.F. signals to said N antenna elements.

19. The feed network as set forth in claim 18, wherein said transforming means comprise N pin polarizers disposed intermediate said N ortho-mode-tees and said N antenna elements.

20. The feed network as set forth in claim 18, wherein said first applying means comprises:

first signal transmission means common to said first signal components of said first and second R.F. signals, and said third R.F. signal; and, second signal transmission means common to said second signal components of said first and second R.F. signals, and said fourth R.F. signal.

21. The feed network as set forth in claim 20, wherein said beam forming network means comprises:

a first beam forming network for receiving signals only from said first signal transmission means; and, a second beam forming network for receiving signals only from said second signal transmission means.

22. The feed network as set forth in claim 21, wherein said fourth applying means comprises fourth signal transmission means common to said N output first, second, third, and fourth R.F. signals.

23. The feed network as set forth in claim 22, wherein the antenna system is a phased array antenna system.

24. The feed network as set forth in claim 22, wherein the antenna system is a reflector antenna system, and said antenna elements comprise feed horns.

25. The feed network as set forth in claim 22, wherein said first, second, third, and fourth R.F. signals occupy different frequency bands.

* * * * *